US008225949B2

(12) United States Patent
Aneas

(10) Patent No.: US 8,225,949 B2
(45) Date of Patent: Jul. 24, 2012

(54) PLUG DEVICE FOR A CONTAINER AND CONTAINER PROVIDED WITH ONE SUCH DEVICE

(75) Inventor: Antoine Aneas, Menetrol (FR)

(73) Assignee: Biocorp Recherche Et Developpement, Saint Beauzire (FR)

( * ) Notice: Subject to any disclaimer, the term of this patent is extended or adjusted under 35 U.S.C. 154(b) by 835 days.

(21) Appl. No.: 12/085,325

(22) PCT Filed: Nov. 29, 2006

(86) PCT No.: PCT/FR2006/002616

§ 371 (c)(1),
(2), (4) Date: Nov. 12, 2008

(87) PCT Pub. No.: WO2007/063218

PCT Pub. Date: Jun. 7, 2007

(65) Prior Publication Data

US 2010/0224632 A1 Sep. 9, 2010

(30) Foreign Application Priority Data

Nov. 30, 2005 (FR) ..... 05 12172
Apr. 20, 2006 (FR) ..... 06 03508

(51) Int. Cl.
*B65D 51/00* (2006.01)

(52) U.S. Cl. ..... 215/249; 215/296; 220/801; 220/315; 220/800; 604/415; 604/411; 604/905

(58) Field of Classification Search ..... 220/801, 220/315, 802, 800; 215/249, 247, 272, 273, 215/277, 296; 604/415, 411, 905, 256, 201, 604/200

See application file for complete search history.

(56) References Cited

U.S. PATENT DOCUMENTS

| | | | | |
|---|---|---|---|---|
| 5,314,084 | A | 5/1994 | Folta | |
| 5,421,469 | A | 6/1995 | Lee | |
| 5,602,530 | A | 2/1997 | Homgren | |
| 6,258,078 | B1 * | 7/2001 | Thilly | 604/411 |
| 8,070,739 | B2 * | 12/2011 | Zinger et al. | 604/411 |
| 8,075,550 | B2 * | 12/2011 | Nord et al. | 604/533 |
| 2001/0000794 | A1 * | 5/2001 | Daubert et al. | 604/200 |
| 2001/0001116 | A1 * | 5/2001 | Daubert et al. | 604/200 |
| 2002/0022804 | A1 * | 2/2002 | Connolly et al. | 604/201 |
| 2010/0050575 | A1 * | 3/2010 | Aneas | 53/485 |

FOREIGN PATENT DOCUMENTS

CA 2038943 1/1991

(Continued)

*Primary Examiner* — Mickey Yu
*Assistant Examiner* — Kareen Rush
(74) *Attorney, Agent, or Firm* — Dowell & Dowell, PC

(57) ABSTRACT

The closure device (500) comprises a stopper (501) made of elastomer and a cover (502) suitable for covering both the neck (12) of a container and stopper (501) in place in said neck (12). The cover (502) is made of plastics material and comprises a ring (503) and a drive member (504). The ring (503) may surround the stopper (501) and the neck (12) in the mounted configuration, the ring being provided with locking means (503G) for locking on the neck (12). The drive member (504) may be mounted on the ring (503) in arbitrary angular orientation about a central axis ($X_{503}$) of the ring. The drive member is provided with an annular edge (505D) suitable for being engaged between an outer skirt (503A) of the ring (503) and at least one tab (503G) forming locking means and extending radially towards the central axis ($X_{503}$) of the ring from the skirt (503A).

20 Claims, 11 Drawing Sheets

FOREIGN PATENT DOCUMENTS

| | | |
|---|---|---|
| EP | 0837008 | 4/1998 |
| JP | 4501249 | 3/1992 |
| JP | 09286453 | 11/1997 |
| WO | 2005/000703 | 1/2005 |

* cited by examiner

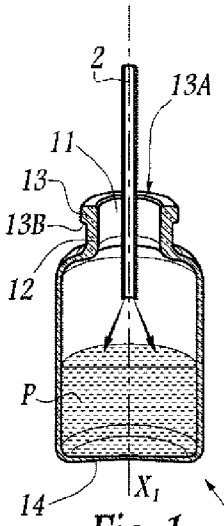
Fig.1
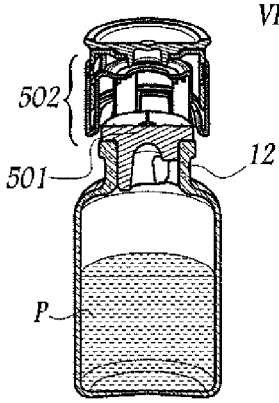
Fig.2
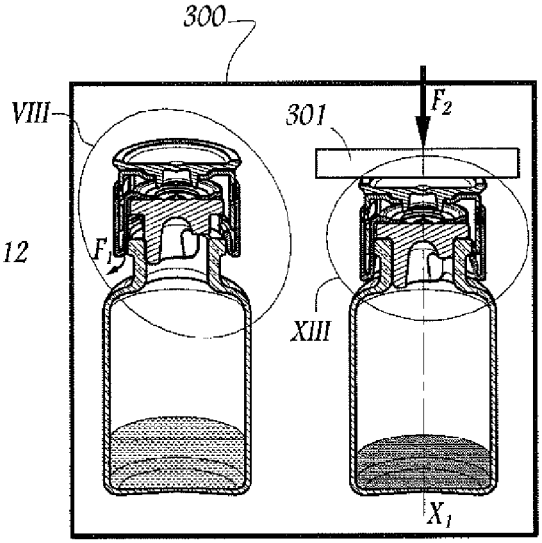
Fig.3
Fig.4
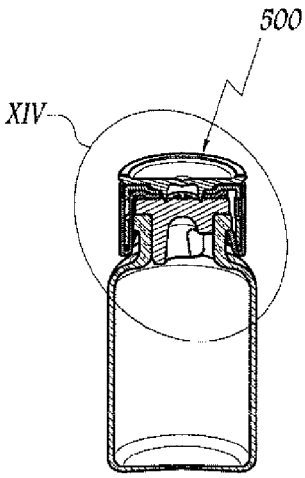
Fig.5
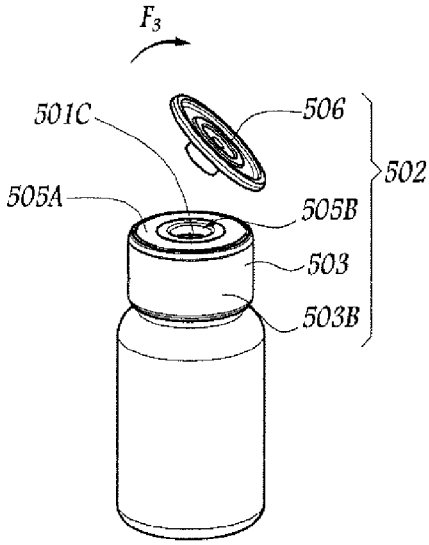
Fig.6
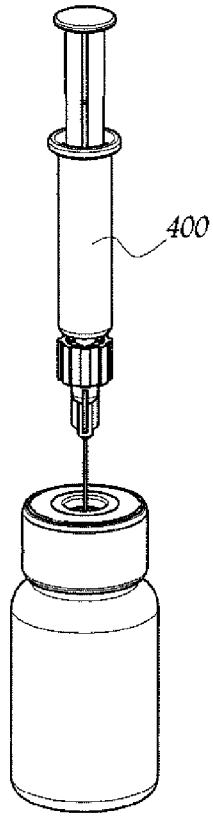
Fig.7

PLUG DEVICE FOR A CONTAINER AND CONTAINER PROVIDED WITH ONE SUCH DEVICE

BACKGROUND OF THE INVENTION

1. Field of the Invention

The invention relates to a closure device for a container having a neck, and also to a method of mounting such a device, and to a container fitted with such a device.

2. Description of the Related Art

In the field of containers for medication, it is known to use a glass vial for conserving an active principle in the form of a freeze-dried lyophilisate, a powders, or a liquid solution. Such a vial needs to be closed in sealed manner so as to keep its content in a satisfactory state of conservation until the time it is used. In order to close a vial hermetically, it is known to use a closure device that comprises an elastomer stopper having the function of being completely leaktight against gas, liquids and bacteria, a capsule made of metal, usually aluminum, that provides a sealing function, and a "flip-off" tongue that performs a tamperproofing indicator function and that needs to be removed before it is possible to gain access to the stopper.

When the metal capsule is crimped onto the top portion of a glass vial, it is possible for particles of glass to become detached from the vial, which particles can drop onto the top of the stopper and constitute a risk of polluting the content. In addition, the metal capsule is not crimped on immediately after the stopper has been put into place, regardless of whether the content of the vial has or has not been subjected to a freeze-drying stage. The time interval between putting the stopper into place and putting the capsule into place can be quite long since it is not unusual for the machine for crimping the capsule to be located in premises distinct from the premises where the content of the vial is sterilized, said distinct premises generally not being sterile. During this time interval, it is therefore possible for the content of the vial to be contaminated, whether accidentally or maliciously. When the vial is used, hospital staff are supposed, after removing the tamperproofing tongue, to decontaminate the top face of the stopper that becomes accessible through the opening formed in the capsule. That operation is sometimes forgotten, thereby likewise leading to a risk of contamination.

US-A-5 314 084 discloses using an outer cover for locking an inner cover into position on the neck of a container in order to protect a stopper. That mode of locking relies on the elasticity of the outer cover and is not always effective.

SUMMARY OF THE INVENTION

The present invention seeks more particularly to remedy those drawbacks by providing a novel closure device that is particularly easy to put into place and that enables an elastomer stopper to be protected immediately from the end of the filling operation and/or the freeze-drying cycle.

To this end, the invention relates to a closure device for a container provided with a neck, the device comprising an elastomer stopper and a plastics material cover, suitable for covering both the neck and the stopper when in place in the neck, and comprising a ring suitable for surrounding the stopper and the neck in an assembled configuration, the ring being provided with locking means for locking on the neck, and a drive member suitable for being mounted on the ring with arbitrary angular orientation about a central axis of the ring, the drive member being provided with activator means for activating the locking means for locking the ring. This device is characterized in that the activator means of the drive member comprise an annular edge of the drive member, the edge being suitable for being engaged between an outer skirt of the ring and at least one tab forming locking means and extending radially towards the axis from the skirt.

Because the cover is made of plastics material, there is no risk of it causing polluting particles of glass to be generated by coming into contact with the surface of the container. Because its structure comprises a ring and a drive member, the ring can be put into place on the receptacle in particularly easy manner, the activator means of the drive member being capable of activating the locking means of the ring when the ring has reached its final position on the neck of the container. Since the drive member can be mounted on the ring in an arbitrary angular orientation, the cover is made easier to mount. In addition, the locking obtained by the annular rim of the drive member is particularly simple and quick, and does not rely on the elasticity of the ring. It is easy to automate mounting and locking the device on a container.

According to aspects of the invention that are advantageous but not essential, such a device may include one or more of the characteristics of claims 2 to 18.

In particular, the drive member may be constituted by an annular element that carries the first and second means together with a cap that is prevented from moving on said annular element by means of tabs hooking onto the edge of a central opening in the annular element, with it being possible to mount the cap on the annular element only by deforming said element elastically, said deformation being the result of a force that can be exerted only prior to the drive member being mounted on said ring. Under such circumstances, each tab is advantageously provided with a catch for hooking onto the edge of the opening, with the distance between the catch and the face of the cap bearing against the annular element being less than the distance, as measured parallel to a central axis of the annular element when the cap is not fitted on said element, between the edge and a portion of the annular element that receives the above-mentioned face of the cap bearing thereagainst.

The invention also provides a method of mounting a device as described above, which method comprises consisting in:

a) exerting on the edge of the central opening of the annular element a force that is generally parallel to a central axis of the opening, the force being applied against a side of the annular element opposite from the side via which the cap is to be mounted, the force being exerted in such a manner as to deform the edge elastically; and b) pressing the cap towards the annular element in a direction opposite to the direction of the force, so as to bring its hooking tabs into engagement against the elastically-deformed edge of the above-mentioned opening.

The invention also provides a container fitted with a closure device as described above. Such a container is easier to close and to use than are containers in the state of the art.

DESCRIPTION OF THE DRAWINGS

The invention can be better understood and other advantages thereof appear more clearly in the light of the following description of three embodiments of a receptacle and of a device in accordance with the principle of the invention, given purely by way of example and made with reference to the accompanying drawings, in which:

FIGS. 1 to 5 are diagrammatic axial section and perspective views showing various steps in packaging a product in a vial in accordance with the invention;

FIGS. 6 and 7 are diagrammatic perspective views showing two steps of using the vial;

DESCRIPTION OF THE PREFERRED EMBODIMENTS

Figure 13:
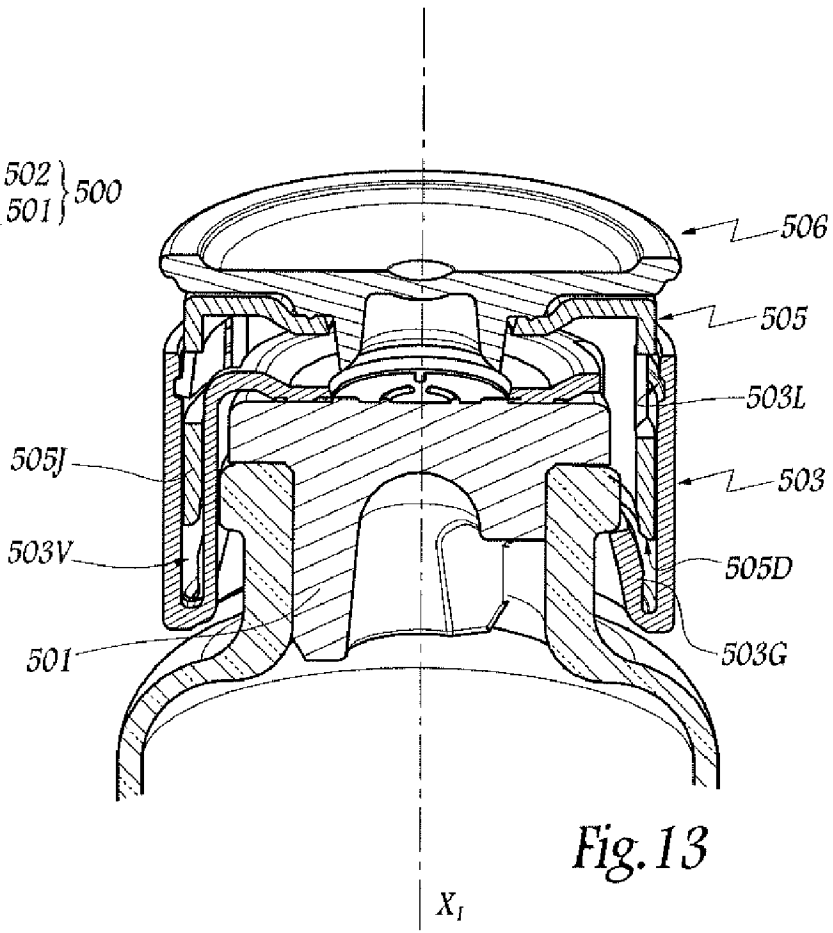
FIG. 13 is a view on a larger scale of a detail XIII of FIG. 4, the presser plate being omitted.

In FIG. 1, a glass vial 1 is being filled with a product P, e.g. with medication. A pipette 2 is introduced into the vial through its opening 11 defined by a neck 12 presenting an outwardly-directed rim 13. The axis of symmetry of the vial 1 is referenced $X_1$.

When a predetermined quantity of product P has been introduced into the vial 1, the pipette is withdrawn and a closure device 500 is put into place on the neck 12. The device 500 comprises an elastomer stopper 501 of shape adapted to be inserted in part into the opening 11, while resting against the face 13A of the rim 13 that is opposite the bottom 14 of the vial 1. Once in place in the neck 12, the stopper 501 isolates the content of the vial 1 from the outside. The device 500 also comprises a cover 502 designed to cover and isolate the stopper and the neck 12 when the closure device is in the closed configuration.

Figure 9:
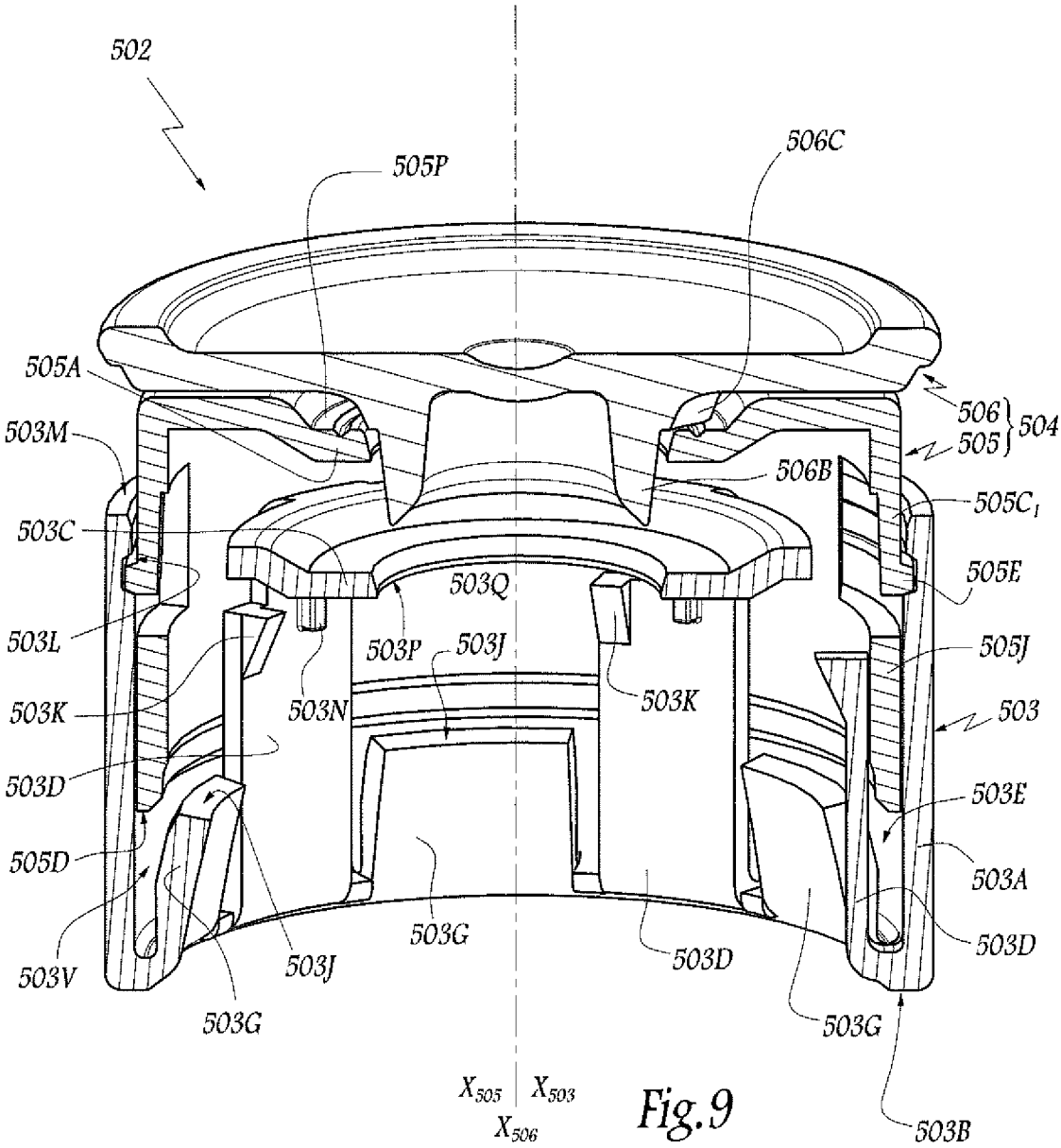
FIG. 9 is an axial section view in perspective and on a larger scale of the cover of the closure device of the vial of FIGS. 1 to 8.
Figure 11A:
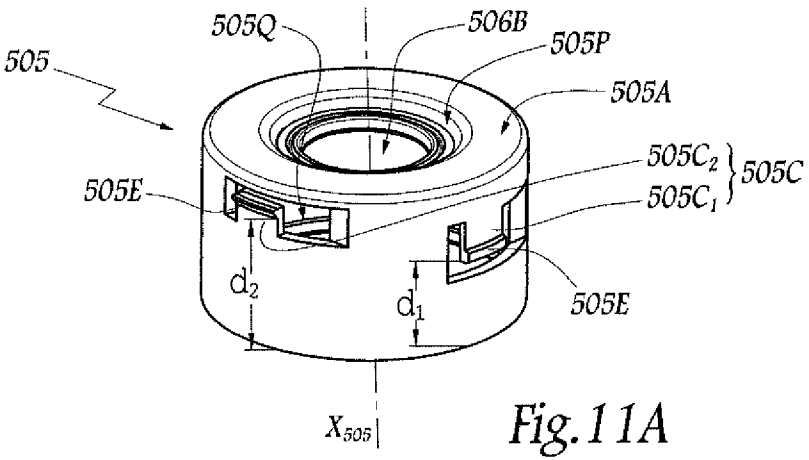
FIGS. 11A and 11B are perspective views from two different angles of a portion of a locking member belonging to the cover of FIG. 9.
Figure 11B:
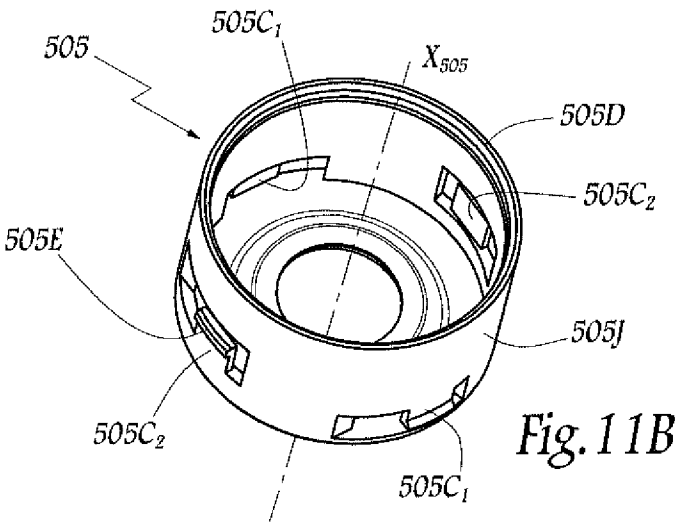

As can be seen more particularly in FIG. 9, the cover 502 comprises a ring 503 of plastics material of inside diameter that is sufficient to enable it to surround the rim 13.

The cover 502 also includes a drive member 504 constituted by a part 505 made of plastics material and referred to below as a "key", and by a cap 506, likewise of plastics material, secured reversibly to the key 505. The cap 506 carries six studs 506A for coming into contact with the outside surface of an annular portion 505A of the key 505 and for being welded thereto by ultrasound. In a variant, spot-welding between the parts 505 and 506 is obtained by localized heating. This can be performed by a heater head and presents the advantage of being faster than heating by ultrasound. Spot-welding via the studs 506A serves to make it easy to withdraw the cap 506 from the key 505, by tearing the studs 506A.

The cap 506 is also provided with an annular lip 506B that is engaged in a central opening 505B of the key 505 when these two elements are secured to each other to constitute the member 504.

The studs 506A are regularly distributed around the central axis $X_{506}$ of the cap 506, and they form an undulating structure 506C for being received in a depression 505P bordering the opening 505B, on the face of the portion 505A that faces towards the stopper 506. The configuration of the depression 505P and of the structure 506C enables the stopper 506 to be centered on the key 505 by co-operating shapes, thereby enabling the axis $X_{506}$ to be aligned on the central axis $X_{505}$ of the key 505 before welding the studs 506A.

The key 505 is provided with two sets of two resilient tongues 505C formed by making four openings 505Q in a skirt 505J formed by the key 505 and centered on the axis $X_{505}$. Reference 505D designates the annular edge of the skirt 505J that is remote from the portion 505A.

Each tongue 505C is provided with an outer rib 505E that projects radially from the skirt 505J. Thus, each tongue 505C forms a resilient hook.

The tongues 505C are organized as two tongues 505$C_1$ having their ribs 505E extending to a first distance $d_1$ from the edge 505D, and two tongues 505$C_2$ having their ribs 505E extending to a second distance $d_2$ from the edge 505D, the distance $d_2$ being greater than the distance $d_1$.

Tongues 505$C_1$ extend, from the edge of the corresponding opening 505Q that is further from the edge 505D and towards the edge 505D. Tongues 505$C_2$ extend from the edge of the corresponding opening 505Q that is closer to the edge 505D, and away from said edge 505D.

Figure 10A:
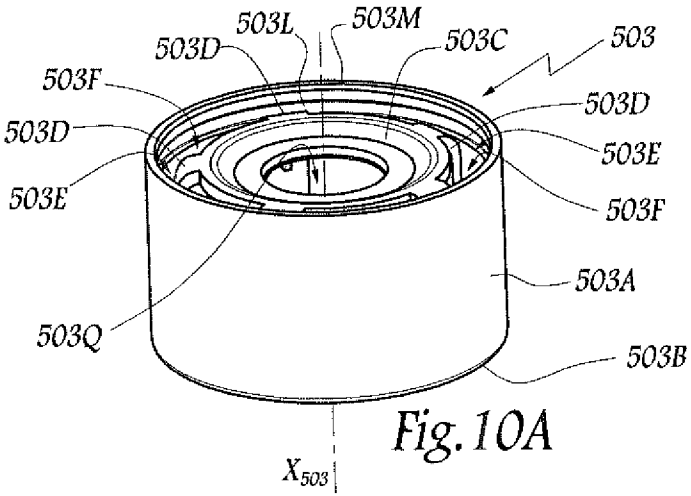
FIGS. 10A and 10B are perspective views from two different angles of a ring belonging to the cover of FIG. 9.
Figure 10B:
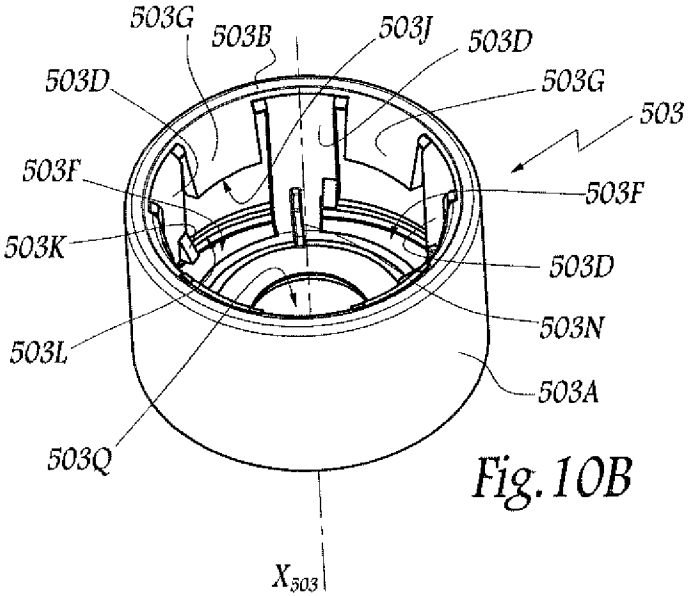

The ring 503 comprises a peripheral annular skirt 503A having a first edge reference 503B. Inside the skirt 503A and opposite the edge 503B, there is formed an annular portion 505C that is generally perpendicular to a central axis $X_{503}$ of the ring 503 and of the skirt 503A. In five angular sectors distributed around the axis $X_{503}$, the portion 503C is extended by five bridges 503D that are connected to the inside surface of the skirt 503A in the vicinity of the edge 503C. The bridges 503D extend at a distance from the inside surface of the skirt 503A so that they define five individual elongate housings 503E in which there can be inserted the skirt 505J of the key 505 via the side of the ring 503 that carries the portion 503C and that is visible in FIG. 10A.

In the angular sectors where the portion 503C is not extended by the bridge 503D, there are formed five openings 503F into each of which it is likewise possible to insert the skirt 505J when the skirt is inserted into the housings 503E. The ends of the bridges 503D and the tabs 503G are disposed in alternation, inside the skirt 503A and in the vicinity of the edge 503B.

Facing each opening 503F, there is provided a locking tab 503G that extends from the inside face of the skirt 503A radially towards the axis $X_{503}$. The free edge of each tab 503G is reference 503J.

Each bridge 503D has provided thereon a ramp 503K for wedging the stopper 501 in the configuration of FIG. 2. The ramps 503K are designed to penetrate superficially into the stopper 501 so as to prevent it from moving relative to the skirt 503.

A rib 503N is provided on each bridge 503D, on the inside face of its portion curved at about 90°, to connect the ring 503 and the stopper 501 in rotation by penetrating radially into the outside surface of the stopper.

The device 500 is assembled by welding the cap 506 onto the key 505, then by aligning with the axis $X_{503}$ the axes $X_{505}$ and $X_{506}$ that already coincide and by engaging the skirt 505J in an annular volume 503V defined between the skirt 503A, the bridges 503D and the locking tabs 503G. Given the annular nature of the edge 505D and of the volume 503V, the member 504 can be mounted on the ring 503 without taking any particular precaution concerning its angular orientation about the axis $X_{503}$. In other words, when the edge 505D is inserted through the entrances to the housings 503E and the openings 503F, towards the volume 503V, the member 504 can have any orientation about the now-coinciding axes $X_{505}$ and $X_{506}$. This makes it easier to mount the cover, since there is no need to check this orientation.

The inside face of the skirt 503A is provided with a peripheral groove 503L formed close to the edge 503M of the skirt 503A that is remote from the edge 503B and adjacent to the portion 503C. The groove 503L is configured to receive the ribs 505E of the tongues 505C when the member 504 is mounted on the ring 503. More precisely, when mounting the member 504 on the ring 503, the skirt 505J penetrates into the volume 503V through the openings 503F and the entry openings to the housings 503E. The skirt 505 then progresses towards the edge 503B until the ribs 505E of the tongues 505$C_1$ engage in the groove 503L, thus enabling the member 504 to be held at a distance from the portion 503C in the position shown in FIG. 9.

It is then possible to insert the stopper 501 into the cover 502 and to wedge it by means of the ramps 503K. The device 500 as made up in this way can be placed on the neck 12 of the vial 1, as shown in FIG. 2. In this configuration, the stopper 501 does not completely close the opening 11 since the stopper has a lateral cutout 501A leaving a gap 200 adjacent to a portion of the face 13A.

Figure 8:
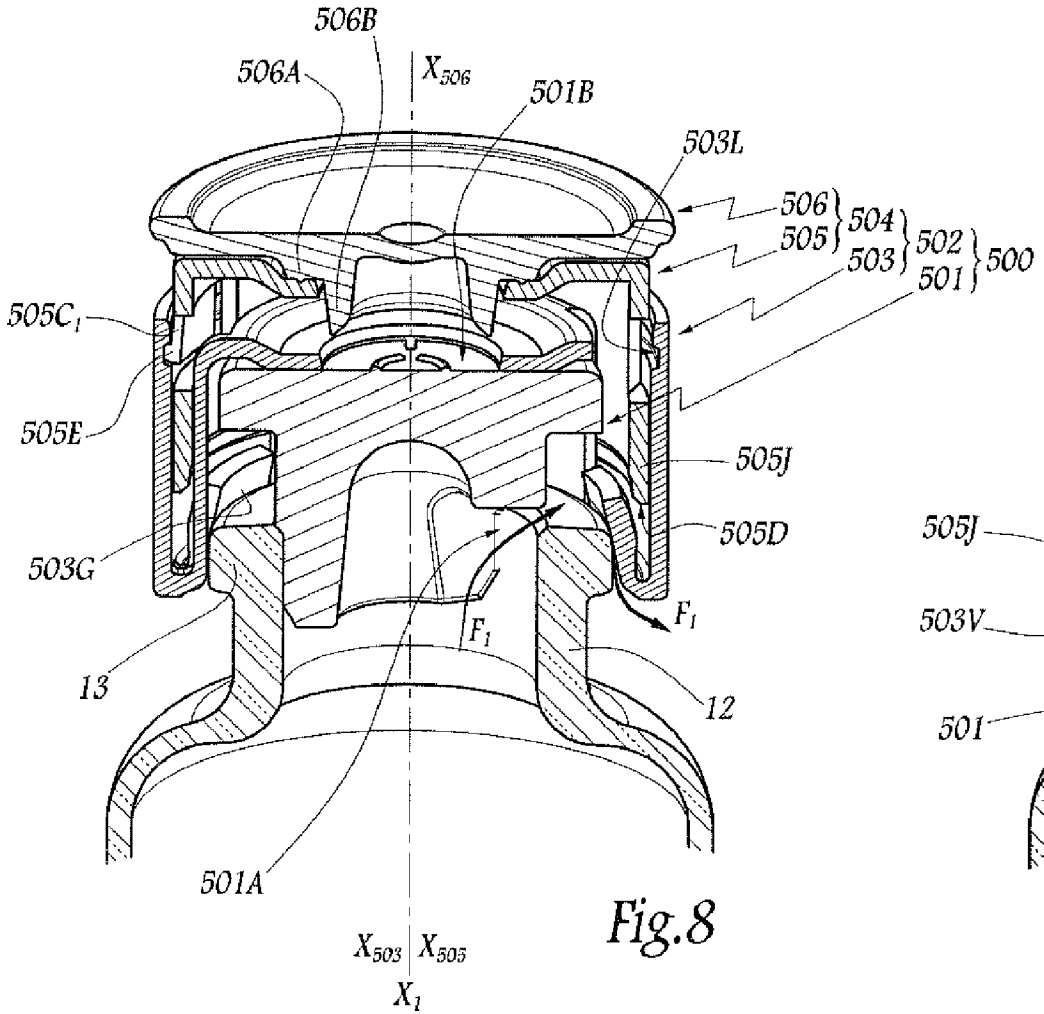
FIG. 8 is a view on a larger scale showing detail VIII of FIG. 4.

The vial 1 fitted with the device 500 can then be placed in a freeze dryer 300 in which molecules of water present in the vial 1 are evacuated to the outside as represented by arrows $F_1$ shown in FIGS. 3 and 8, passing through the gaps that then remain between the cover 502 and the rim 13.

The stopper 501 is provided on its radially-outer surface with stop projections in the configuration shown in FIGS. 3 and 8.

Thereafter, as shown in FIG. 4, it is possible while the device 500 is still inside the freeze dryer 300 to exert a force $F_2$ thereon parallel to the longitudinal axis $X_1$ of the vial 1 and of the opening 11, which axis then coincides with the axes $X_{503}$, $X_{505}$, and $X_{506}$. This axial force $F_2$ is exerted by a plate 301 movable inside the freeze dryer and suitable for exerting simultaneously substantially the same force $F_2$ on the batch of vials 1 placed at the same level in the freezer dryer.

When the force $F_2$ is exerted on the stopper 506 of the member 504, the ribs 505E of the tongues 505; transmit this force to the ring 503 via interaction between these ribs 505E and the groove 503L. The tongues 505$C_1$ thus act as pushers, insofar as they enable the ring 503 to be moved or pushed towards the bottom 14 of the vial 1, under the effect of the force $F_2$, thus making it possible to reach the configuration of FIG. 5. Because of this movement, the locking tabs 503G are folded towards the inside surface of the skirt 503A without it being necessary to deform the skirt 503A radially. Thus, the force $F_2$ that needs to be applied in order to reach the configuration of FIGS. 4 and 13 is relatively low.

Once the locking tabs 503G have gone past the rim 13 and reached the position of FIGS. 4 and 13, the ring 503 can no longer be moved towards the bottom 14 since the portion 503C bears against the stopper 101 which is engaged in the neck 12. Maintaining the force $F_2$ then has the effect of expelling the ribs 505E belonging to the tongues 505$C_1$ from the groove 503L and of moving the member 504 relative to the ring 503 so as to bring the edge 505D into the bottom of the volume 503V between the locking tabs 503G and the inside surface of the skirt 503A. This engagement of the edge 505B between the locking tabs 503G and the skirt 503A has the effect of deforming these tabs radially in a centripetal direction, their respective free edges 503J being moved towards the axis $X_1$. These edges then come to bear against the annular face 13B of the rim 13 that faces towards the bottom 14, such that the capsule 500 is firmly locked on the neck 12, as shown in FIGS. 5 and 14.

Figure 14:
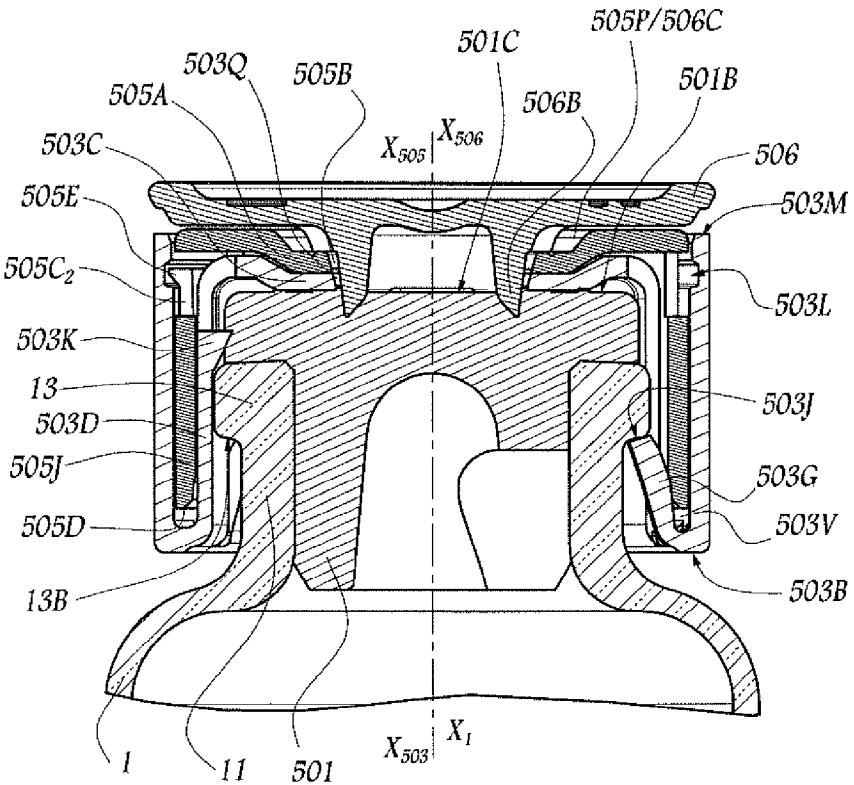
FIG. 14 is a view on a larger scale of a detail XIV of FIG. 5.
Figure 12A:
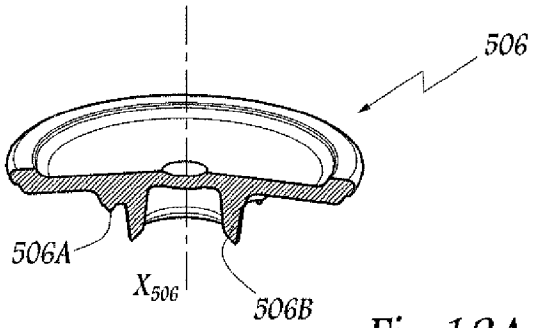
FIGS. 12A and 12B are perspective views from two different angles of a cap belonging to a member for locking the cover of FIG. 9, FIG. 12A being partially cut away.
Figure 12B:
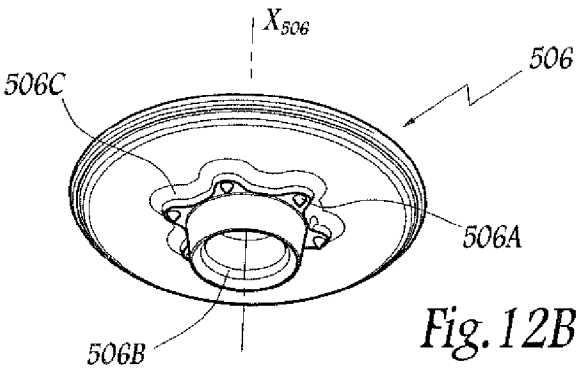

In the configuration of FIGS. 5 and 14, the ribs 505E of the tongues 505$C_2$ come into engagement in the groove 503L, thus serving to prevent the member 504 from moving relative to the ring 503. In other words, the difference between the distances $d_1$ and $d_2$ corresponds to the stroke of the member 504 between the positions of FIGS. 4 and 5, thus enabling the retaining tongues 505$C_2$ to be brought automatically into engagement with the groove 503L when the locking tabs 503G are locked in the position for retaining the cover 502 on the neck 12.

Because of this movement, the ribs 503N penetrate superficially into the stopper 501, thereby holding the stopper 501 securely against turning relative to the ring 503.

Thus, final positioning of the cover 502 takes place in two stages. In the first stage, the stopper 501 is put into place and the tabs 503G are folded towards the skirt 503A so as to go past the rim 13. In the second stage, the tabs 503G are locked in position by the edge 505D. These two stages are performed by a thrust force $F_2$ of magnitude that can be adapted to each stage, while conserving a value that is significantly less than that which would be required for positioning in a single stage, insofar as the friction forces to be overcome and the deformation forces to be delivered are separated in time by means of the invention, being distributed between the two stages. In addition, since the skirt 503A is not expanded radially while the tabs 503G are passing over the rim 13, the force $F_2$ can be relatively small, thereby making it easier to put the cover 500 into place.

To summarize, in the first stage, the configuration goes from that of FIG. 3 to that of FIG. 4. In the second stage, the configuration goes from that of FIG. 4 to that of FIG. 5.

In this configuration, the vial 1 is closed hermetically by the stopper 501 and is protected by the cover 502, which cover cannot be withdrawn because of the locking obtained by the tabs 503G.

In this configuration, as shown in FIG. 14, the lip 506B of the cap 506 comes to bear through the opening 505B and through the central opening 503A of the portion 503C against the outside surface 501B of the stopper 501 that is to be exposed when it is desired to gain access to the content of the vial 1. Under the action of the lip 506B, the surface 501B deforms locally, as can be seen in FIG. 14, since the material of the stopper 501 is more flexible than that of the cap 506.

More precisely, the lip 506B completely isolates a disk-shaped central portion 501C of the surface 501B, which portion can be considered as being clean and sterile since it was isolated from the outside while still within the freeze dryer 300.

When it is appropriate to use the content of the vial 1, the cap 506 is removed by breaking the studs 506A, as represented by arrow $F_3$ in FIG. 6, thus giving access to the above-mentioned portion 501C, which does not need to be decontaminated. It is then possible to inject a liquid into the vial 1 for reconstituting its content, by means of a syringe 400, as shown in FIG. 7, and then to pump out the reconstituted product using the same syringe with its needle passing through the stopper 501 in an approach that is known to hospital staff.

Figures 15, 16:
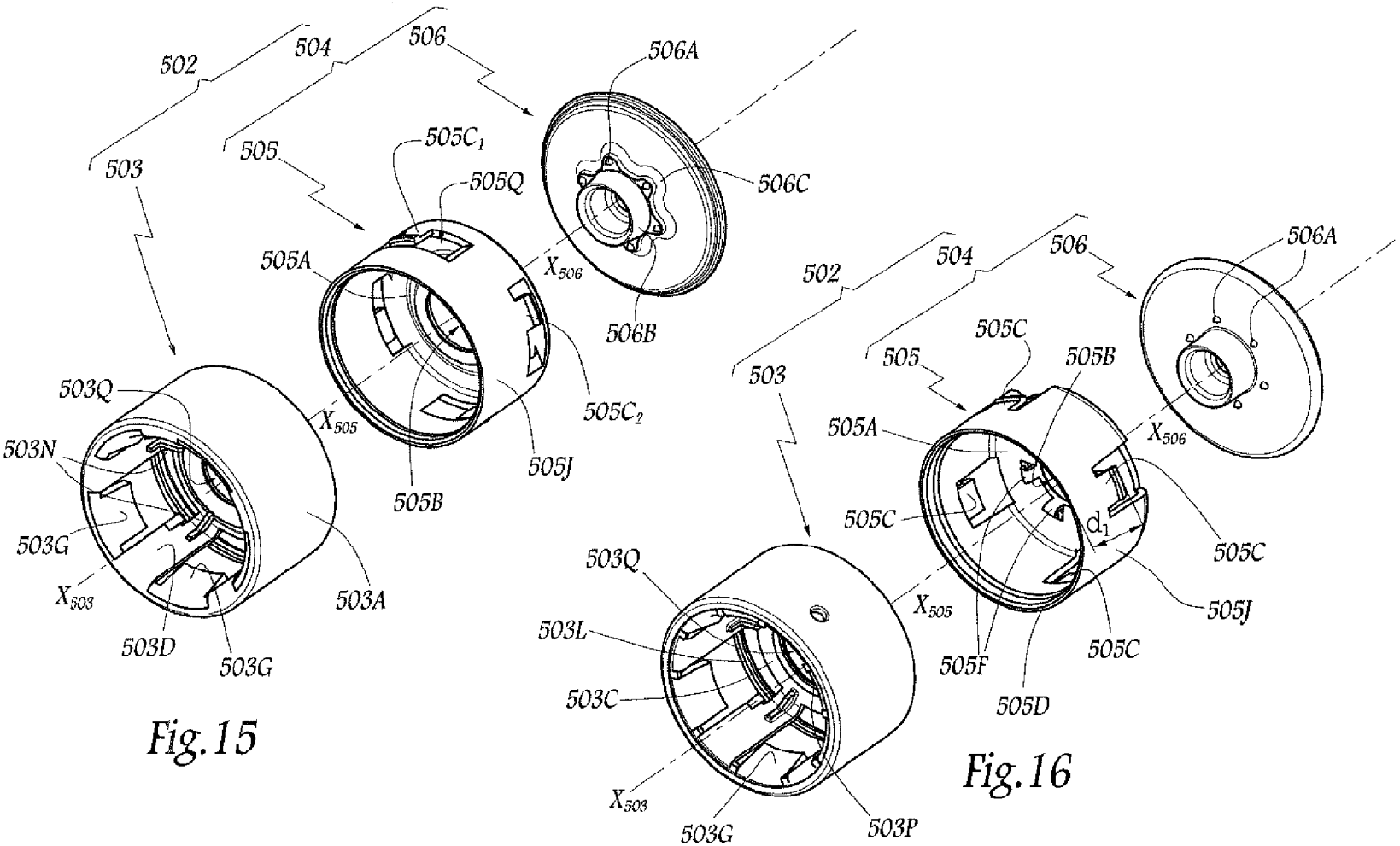
FIG. 15 is an exploded perspective view of the cover of FIG. 9.
FIG. 16 is an exploded perspective view of a second embodiment of the cover.

In the second embodiment shown in FIG. 16, elements analogous to those of the above embodiment are given identical references. The cover 502 of this embodiment likewise comprises a ring 503 and a drive member 504 formed by a key 505 and a cap 506. This embodiment differs from the above embodiment in that the four tongues 505C of the key 505 are all of the same type and they extend to the same distance $d_1$ from the annular edge 505D of the skirt 505J. These four tongues 505C have the same function as the tongues 505$C_1$ in the above embodiment and they come simultaneously into engagement in a groove 503L formed in the inside of the ring 503 that is identical to the ring in the above embodiment.

The annular portion 505A of the key 505 is provided with six hooks, only two of which can be seen in FIG. 16 under the reference 505F beside the opening 505B adjacent to the portion 505A facing towards the edge 505D. These six hooks 505F are designed to engage with the edge 503P of the central opening 503Q defined by the annular portion 503C of the ring 503. This engagement occurs when the member 504 passes from a position corresponding to that of FIG. 4 to a position corresponding to that of FIG. 5, i.e. when the edge 505D of the key 505 brings the tabs 503G of the ring 503 into the locking configuration on the neck 12. The hooks 505F thus have a function similar to the function of the second tongues 505$C_2$ in the above embodiment.

In the third embodiment shown in FIGS. 17 to 26, elements analogous to those of the first embodiment are given the same references. Below, the description relates essentially to the differences between the first and third embodiments.

The cap 506 of the cover 502 carries four tabs 506A that are to be hooked onto the edge 505$B_1$ of a central opening 505B in the key 505. For this purpose, each tab 506A is provided with a catch 506$A_1$ molded integrally with the cap 506 and extending radially outwards, from the tab 506A in question, relative to a central axis $X_{506}$ of the cap 506. The catches 506$A_1$ are engaged under the edge 505$B_1$ when the key 505 and the cap 506 are assembled together to form the member 504. More precisely, the cap 506 is provided with a surface 506C that is substantially plane whereby it bears against a top surface 505$A_1$ of an annular portion 505A of the key 505 having the opening 505B defined in its center. In the assembled configuration of the member, the catches 506$A_1$ engage against the edge 505$B_1$, on its side remote from the surface 505$A_1$.

The number of tabs 506A is not limited to four, providing they serve to distribute the hooking force between the key 505 and the cap 506.

The key 505 is provided with a set of three resilient tongues 505C formed by creating three openings 505A in a skirt 505J formed by the key 505 and centered on an axis $X_{505}$ that constitutes a central axis of the key 505. The annular edge of the skirt 505J that is remote from the portion 505A is written 505D.

Each tongue 5050 is provided with an outer rib or catch 505E that projects radially from the skirt 505J. Thus, each tongue 505C forms a resilient hook.

The distance, taken parallel to the axis $X_{505}$ between the ribs 505E and the edge 505D, is written $d_1$.

Furthermore, the key 505 is provided with a peripheral rim 505R that projects radially from the skirt 505J and that extends continuously between two openings 505Q. The distance, taken parallel to the axis $X_{505}$ between the free edge 505$R_1$ of the rim 505 and the edge 505D, is written $d_2$. The value of $d_2$ is greater than the value of $d_1$.

The rim is generally frustoconical about the axis $X_{505}$ and diverges going away from the edge 505D.

The ring 503 is identical to that of the first embodiment.

Figure 25:
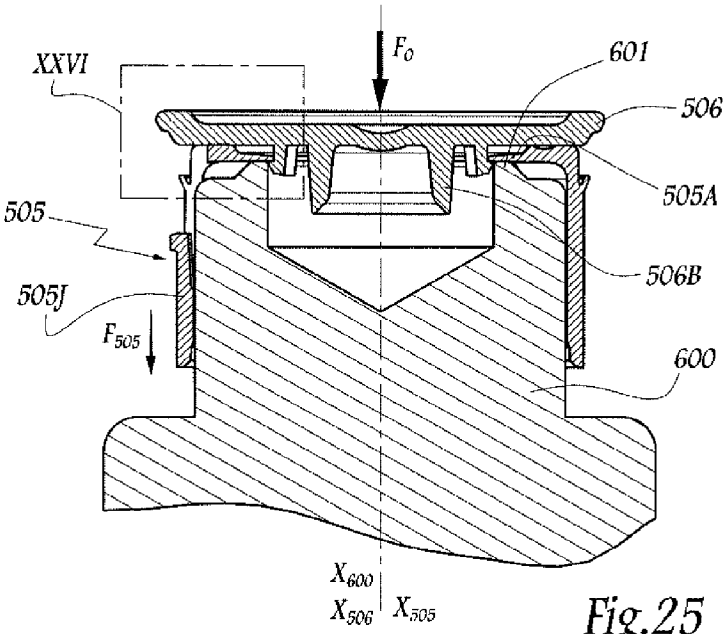
FIG. 25 is a view of the drive member during assembly.

When the cap 506 is to be mounted on the key 505, it is necessary to engage the catches 506$A_1$ against the edge 505$B_1$ through the opening 505B. To do this, as shown in FIG. 25, the key 505 is placed on a tool 600 that defines an annular surface 601 for receiving the portion 505A of the key 505 bearing thereagainst. The stopper 506 is then presented above the key 505, with the axes $X_{505}$ and $X_{506}$ substantially in alignment, the axis $X_{506}$ already being in alignment on a central axis $X_{600}$ of the tool 600. The cap 506 is then pushed towards the tool 600 with a force $F_0$ parallel to the axes $X_{505}$, $X_{506}$, and $X_{600}$, thereby having the effect of engaging the lip 506B in the opening 505B and then causing the catches 506$A_1$ to bear against the edge 505$B_1$ of the opening 505B. When the force $F_0$ is maintained on the cap 506, the surface 506C comes to bear against the top surface 505$A_1$ of the portion 505A and transmits a force $F'_0$ to the key 505, thereby causing the skirt 505J to slide in the direction of arrow $F_{505}$ in FIG. 25, i.e. towards the base of the tool 600. Insofar as the portion 505A of the key 505 is already bearing against the surface 601, a reaction force $F_{600}$ is exerted by the surface 601 on the bottom surface 505$A_2$ of the portion 505A as defined beside the portion 505A remote from the cap 506. The force $F_{600}$ opposes the force $F_0$.

Figure 26:
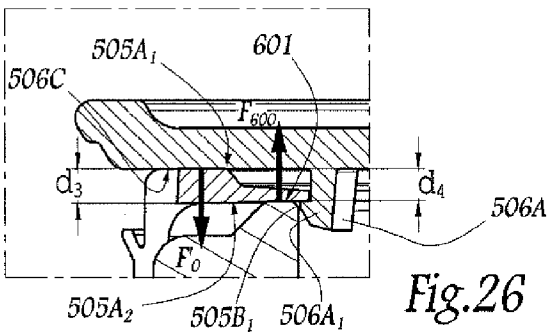
FIG. 26 is a view on a larger scale showing a detail XXVI of FIG. 25.
Figure 24:
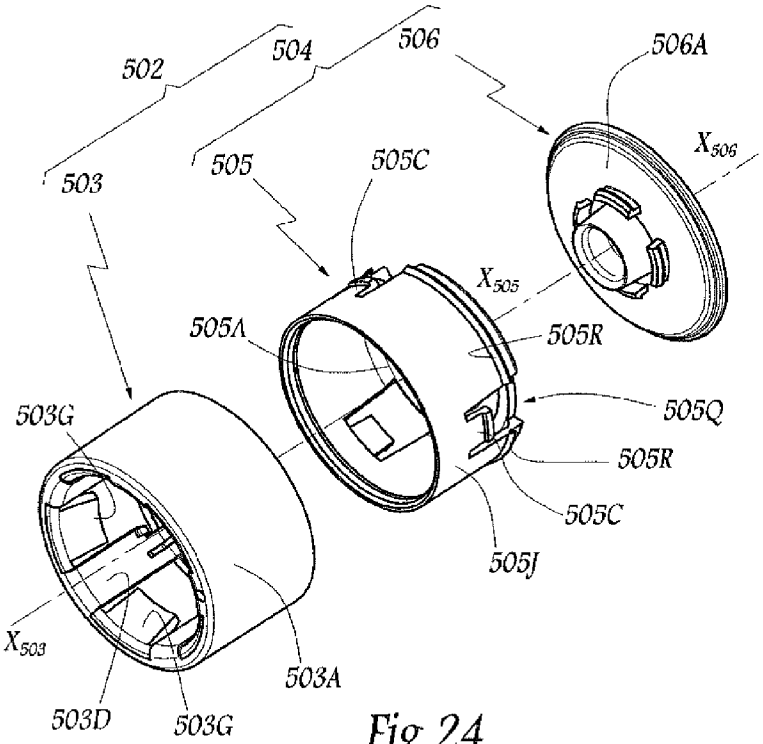
FIG. 24 is an exploded perspective view of the cover of FIG. 17.

This has the effect of bringing the edge 505$B_1$ closer to the surface 506C, thereby enabling the catches 506$A_1$ of the tabs 506A to go beyond said edge and engage under it, as shown in FIG. 26.

This engagement of the catches 506$A_1$ under the edge 505$B_1$ is possible only by virtue of the edge 505$B_1$ deforming elastically, which deformation is obtained by means of the reaction force $F_{600}$.

The distance, taken parallel to the axis $X_{505}$ between the edge 505$B_1$ and the region of the portion 505A that receives the cap 506 bearing thereagainst in the configuration of FIG. 26, is written $d_3$. Furthermore, the height taken parallel to the axis $X_{506}$ of the tabs 506A between the surface 506C and their respective catches 506$A_1$ is written $d_4$.

At rest, i.e. in the absence of any force exerted on the parts 505 and 506, the distance $d_3$ has a value greater than that of the distance $d_4$. It is only because the tool 600 exerts the reaction force $F_{600}$ on the portion 505A in the direction opposite to the force $F_0$ that the distance $d_3$ is caused temporarily to take on a value that is smaller than the distance $d_4$, thus enabling the catches 505$A_1$ to hook under the edge 505$B_1$ as shown in FIG. 26.

It should be observed that when the member 504 is mounted on the ring 503, it is no longer possible to reach the bottom surface 505$A_2$ of the portion 505A of the key 505 in order to exert the force $F_{600}$.

The device 500 is assembled in the same manner as for the first embodiment, by mounting the cap 506 on the key 505 as explained above, and then by bringing the already-coinciding axes $X_{505}$ and $X_{506}$ into alignment with the axis $X_{503}$, and by engaging the skirt 505J in an annular volume 503V defined between the skirt 503A, the bridges 503D, and the locking tabs 503G. The member 504 may have any orientation relative to the now-coinciding axes $X_{505}$ and $X_{506}$, when the edge 505D is inserted through the entries to the housings 503E and the openings 503F towards the volume 503V.

The inside face of the skirt 503A is provided with a peripheral groove 503L formed close to the edge 503M of the skirt 503A that is remote from the edge 503B and adjacent to the portion 503C. The groove 503L is configured to receive ribs 505E of the tongues 505C when the member 504 is mounted on the ring 503. More precisely, while the member 505 is being mounted on the ring 503, the skirt 505J penetrates into the volume 503V through the openings 503F and the entry openings to the housings 503E. The skirt 505 then advances towards the edge 503B until the ribs 505E of the tongues 505C engage in the groove 503L, thereby enabling the member 504 to be kept at a distance from the portion 503C, in the position shown in FIG. 18.

It is then possible to introduce the stopper 501 into the cover 502 and to wedge it by means of the ramps 503K. The device 500 as made up in this way can then be placed on the neck 12 of the vial 1, as shown in FIG. 2 for the first embodiment.

The vial 1 fitted with the device 500 can then be inserted into a freeze dryer 300, as with the first embodiment.

Figure 17:
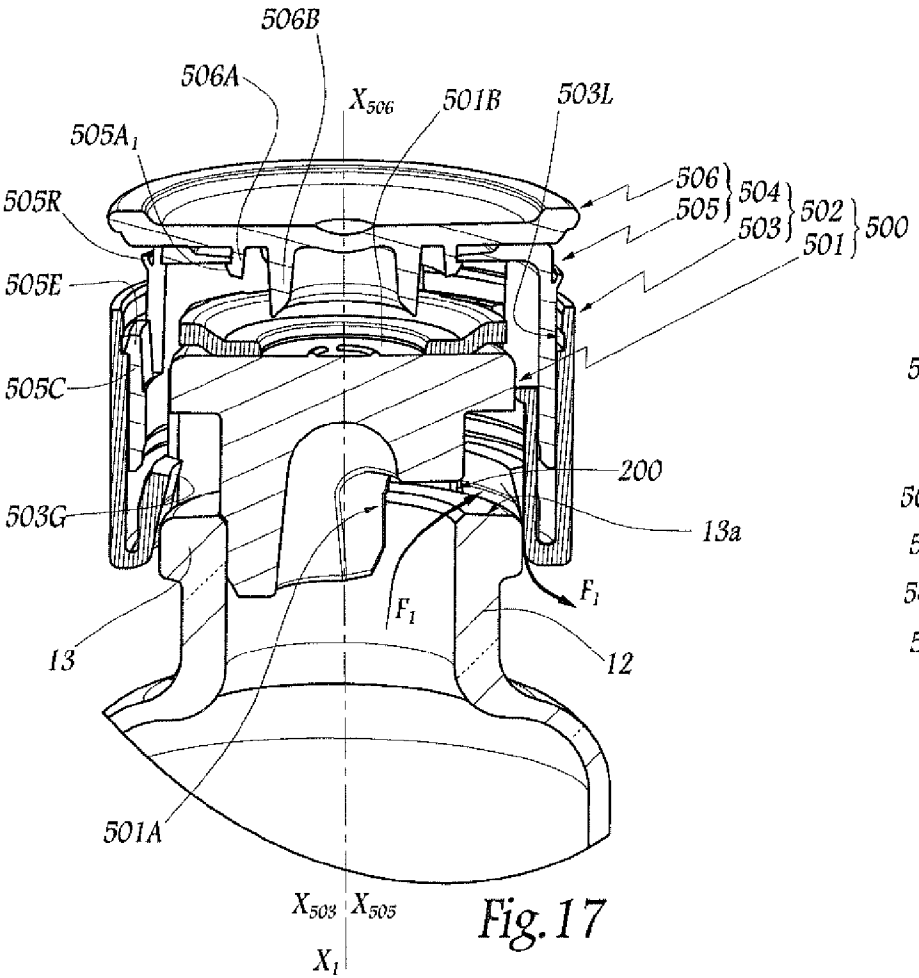
FIG. 17 is a view analogous to FIG. 8 for a device in accordance with a third embodiment of the invention.
Figure 18:
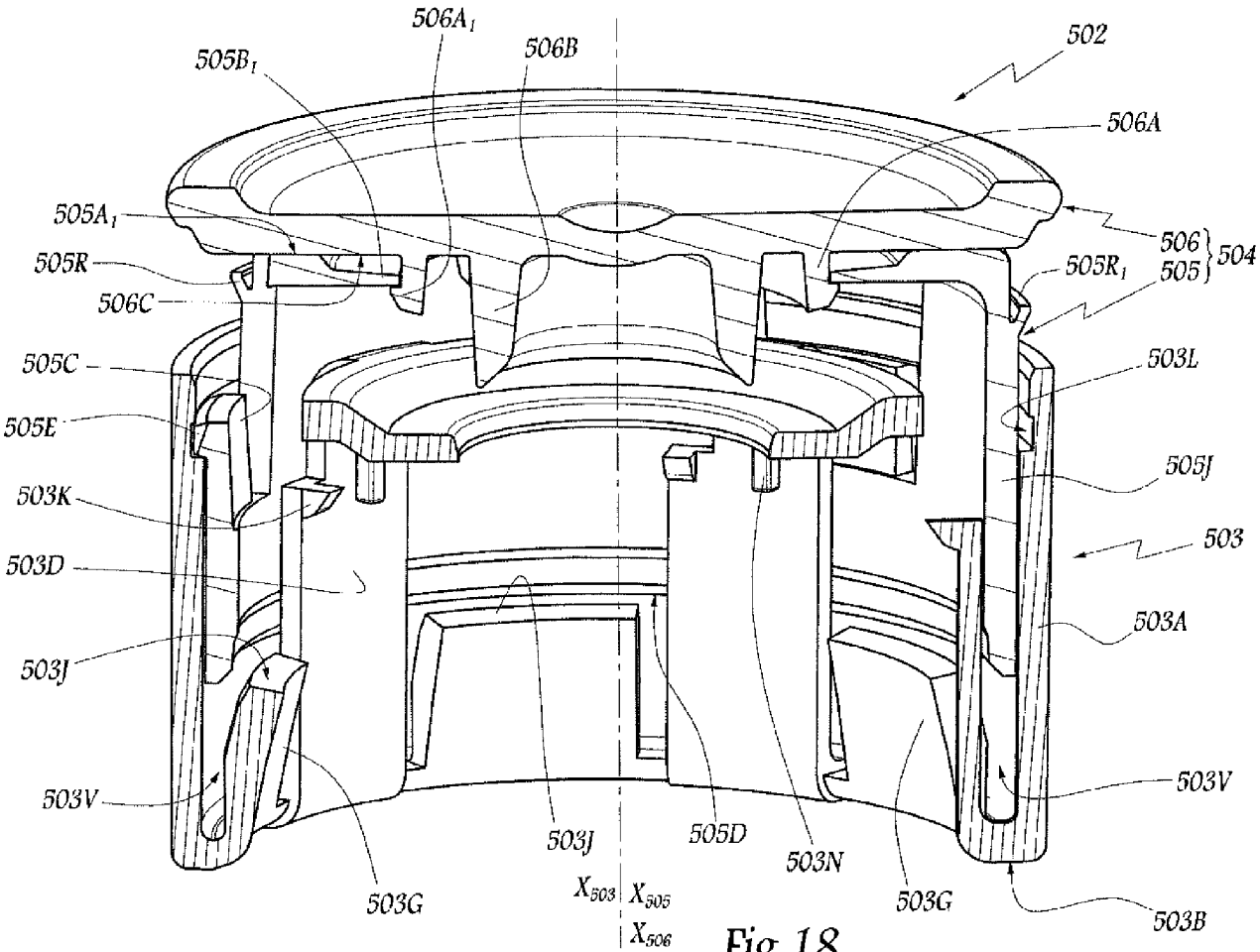
FIG. 18 is an axial section view in perspective and on a larger scale of the cover of the FIG. 17 device.
Figure 20A:
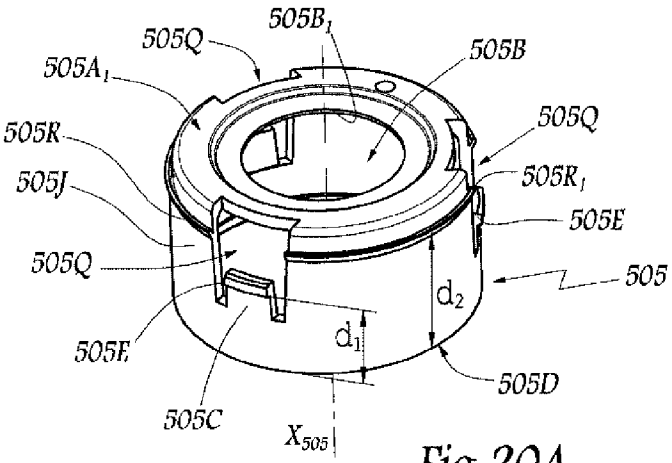
FIGS. 20A and 20B are perspective views from two different angles of a portion of a locking member belonging to the cover of FIG. 18.
Figure 20B:
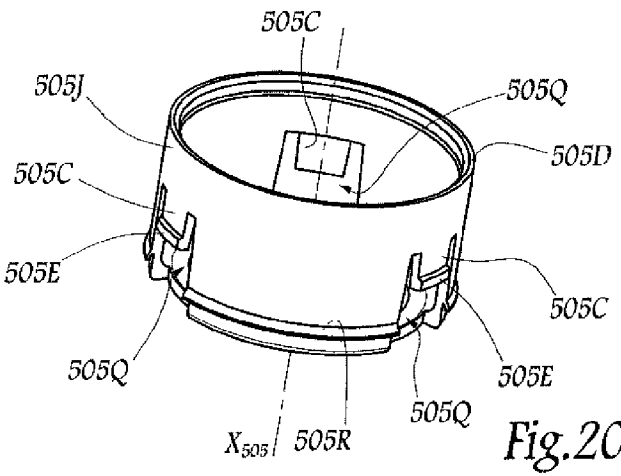
Figure 19A:
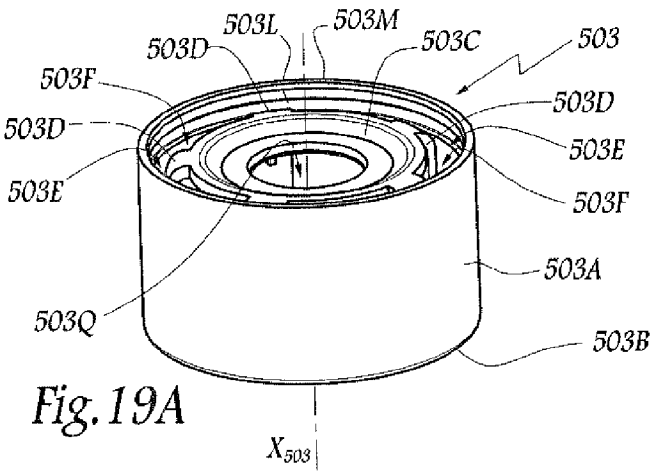
FIGS. 19A and 19B are perspective views from two different angles of a ring belonging to the cover of FIG. 18.
Figure 19B:
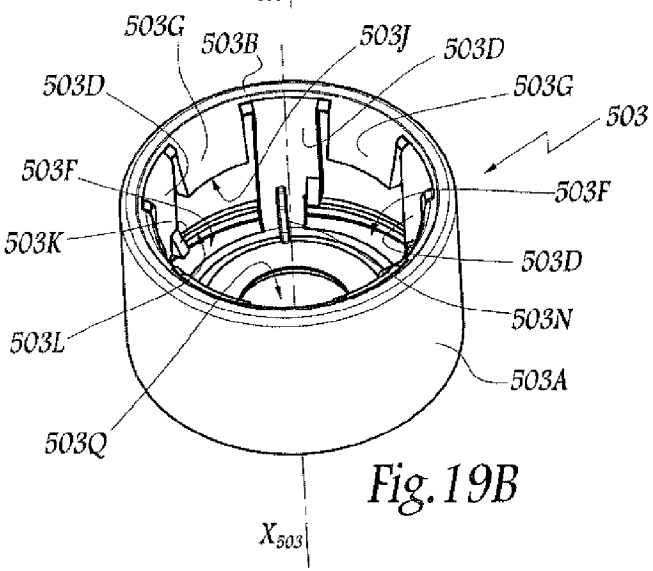

On its radially-outer surface, the stopper 501 is provided with stop projections in the configuration of FIG. 17.

Thereafter, inside the freeze dryer, and as shown in FIG. 4 for the first embodiment, it is possible to exert a force $F_2$ on the device 500 parallel to the longitudinal axis $X_1$ of the vial 1 and of the neck 12, which axis then coincides with the axes $X_{503}$, $X_{505}$, and $X_{506}$ When the force $F_2$ is exerted on the stopper 506 of the member 504, the ribs 505E of the tongues 505C transmit this force to the ring 503 via interaction between said ribs 505E and the groove 503L. The tongues 505C then act as pushers insofar as they serve to move or push the ring 503 towards the bottom 14 of the vial 1, under the effect of the force $F_2$. Because of this movement, the locking tabs 503G are folded towards the inside surface of the skirt 503A without it being necessary to deform the skirt 503A radially. As a result, the force $F_2$ that needs to be applied to reach the configuration of FIG. 22 is relatively low.

Figure 22:
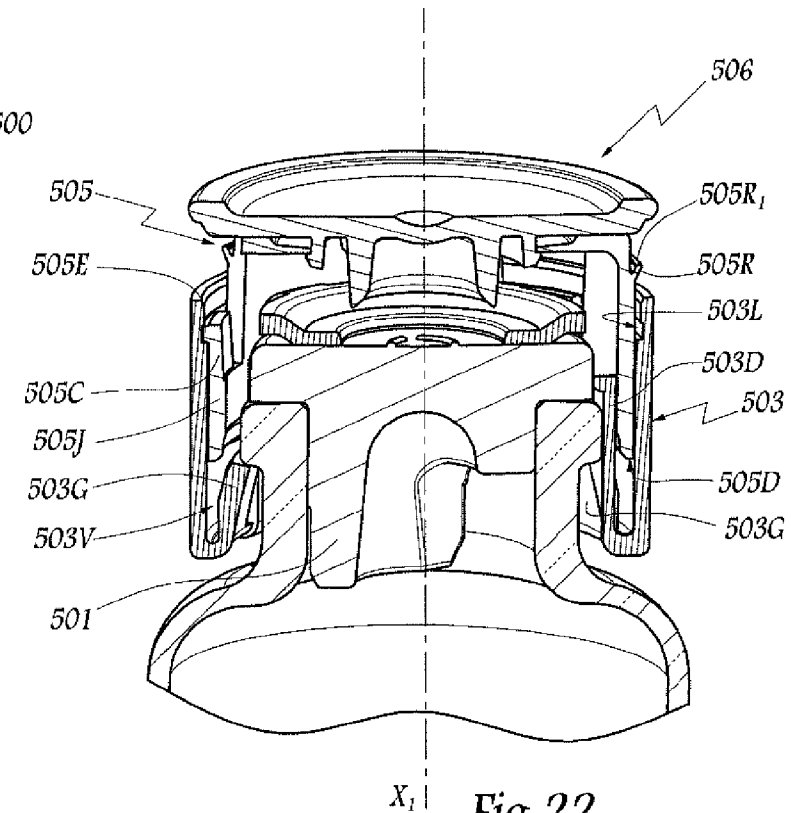
FIG. 22 is a view analogous to FIG. 13 for the device of FIGS. 17 to 21.

Once the locking tabs 503G have gone past the rim 13 and reached the position of FIG. 22, the ring 503 can no longer be moved towards the bottom 14 since the portion 503C bears against the stopper 101 that is engaged in the neck 12. Maintaining the force $F_2$ then has the effect of expelling the ribs 505E from the groove 503L and of moving the member 504 relative to the ring 503 so as to bring the edge 505D into the bottom of the volume 503V between the locking tabs 503G and the inside surface of the skirt 503A. This engagement of the edge 505B between the locking tabs 503G and the skirt 503A has the effect of deforming these tabs radially in a centripetal direction, their respective free edges 503J then being moved towards the axis $X_1$. These edges then come to bear against the annular face 13B of the rim 13 that faces towards the bottom 14, such that the capsule 500 is firmly locked on the neck 12, as shown in FIG. 23.

Figure 23:
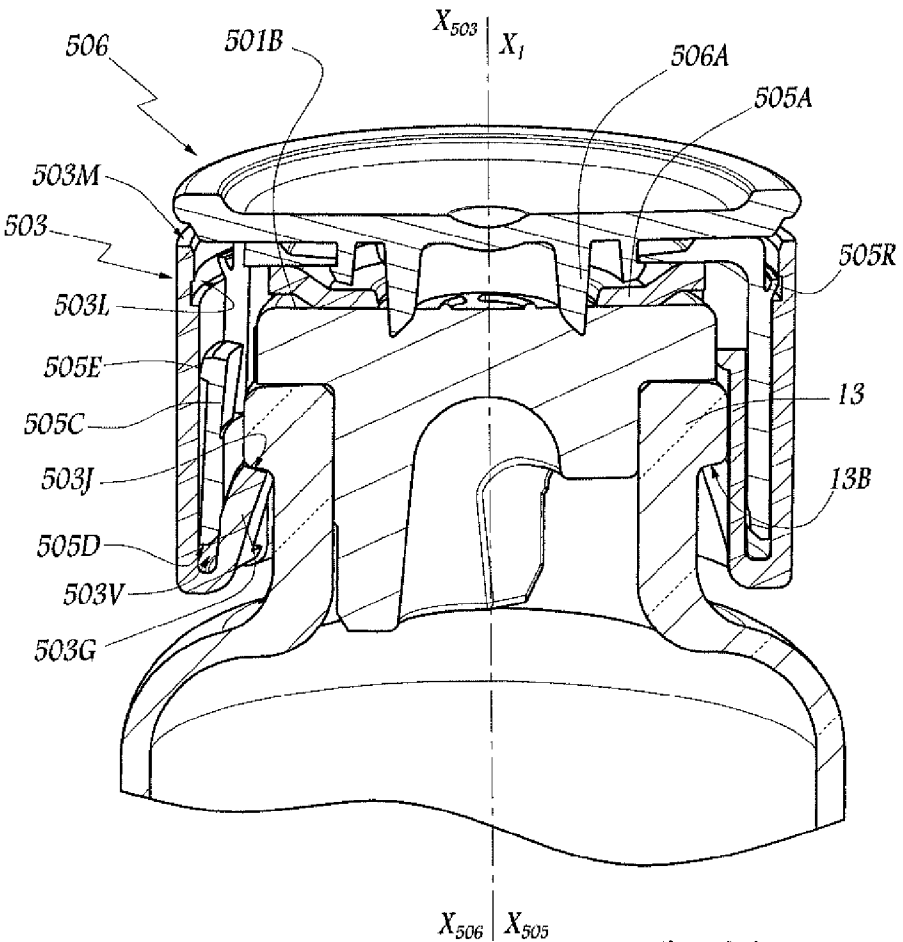
FIG. 23 is a view analogous to FIG. 14 for the device of FIGS. 17 to 22.
Figure 21A:
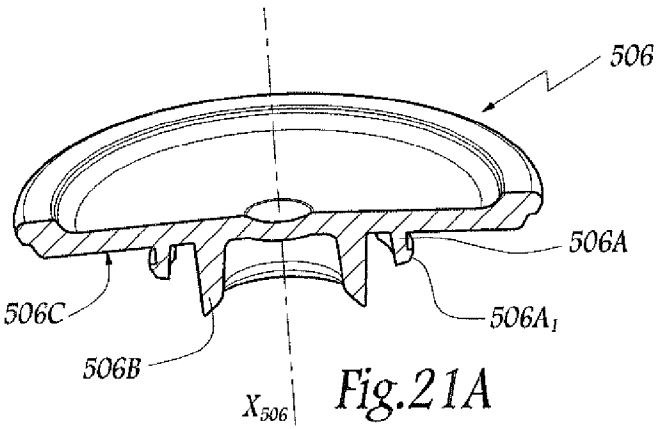
FIGS. 21A and 21B are perspective views from two different angles of a cap belonging to a locking member of the FIG. 18 cover, FIG. 21A being partially cut away.
Figure 21B:
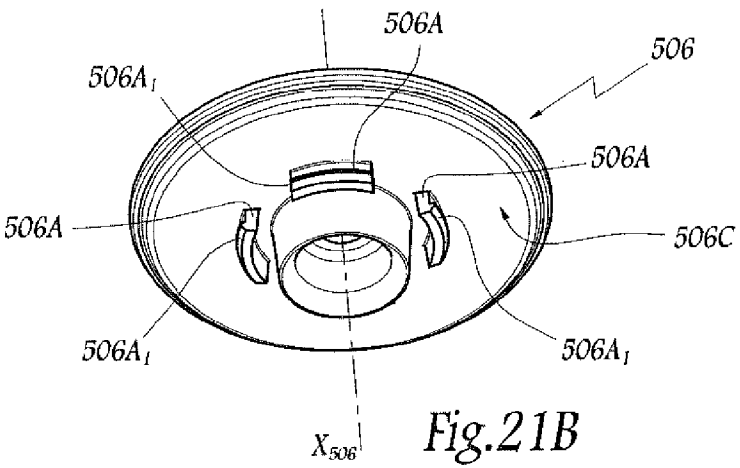

In the configuration of FIG. 23, the rim 505R comes to engage in the groove 503L, thereby serving to prevent the member 504 from moving relative to the ring 503. In other words, the difference between the distances $d_1$ and $d_2$ corresponds to the stroke of the member 504 between the positions of FIGS. 17 and 22, thus making it possible to bring the rim 505R automatically into engagement with the groove 503L when the locking tabs 503G are locked in position for retaining the cover 502 on the neck 12.

Because of this movement, the splines 503N penetrate superficially into the stopper 501, thereby holding the stopper 501 securely against turning relative to the ring 503.

Thus, final positioning of the cover 502 takes place in two stages. In the first stage, the stopper 501 is put into place and the tabs 503G are folded towards the skirt 503A to go beyond the rim 13. In the second stage, the tabs 503G are locked in position by the edge 505D. These two stages are achieved by a thrust force $F_2$ of magnitude that can be adapted to each stage, while conserving a value that is substantially less than that which would be necessary for putting into place in a single stage, insofar as the friction forces to be overcome and the deformation forces to be provided are offset in time by the invention, since they are distributed between the two stages. Furthermore, since the skirt 503A does not need to be expanded radially while the tabs 503G are going past the rim 13, the force $F_2$ can be relatively low, thereby making it easier to put the cover 502 into place.

In summary, the configuration passes in the first stage from that of FIG. 17 to that of FIG. 22. In the second stage, the configuration passes from that of FIG. 22 to that of FIG. 23.

In this configuration, the vial 1 is closed hermetically by the stopper 501 and is protected by the cover 502, which cover is prevented from being removed by the locking obtained by means of the tabs 503G.

In this configuration, as in the first embodiment and as shown in FIG. 23, the lip 506B of the cap 506 comes to bear through the opening 505B and through the central opening 503Q of the portion 503C against the outside surface 501B of the stopper 501 that is to be exposed when it is desired to gain access to the content of the vial.

When it is appropriate to use the content of the vial 1, the cap 506 is removed by centripetal elastic deformation of the tabs 506A, and then the procedure is as described for the first embodiment with reference to FIGS. 6 and 7.

Once the cap 506 has been removed, it is no longer possible to put it back into place since the key 504 returns to a configuration in which the distance $d_3$ is greater than the distance $d_4$. The cap 506 thus acts as an indicator of first opening of the device 500, insofar as it cannot be put back into place after first removal since it is not possible to exert a force analogous to the force $F_{600}$ on the portion 505A since said portion now rests on the portion 503C of the ring 503 and on the stopper 501.

Since all of the closure operations are performed in a medium that is isolated from the outside, the stopper 501 is kept sterile, and in particular its portion 501C is kept sterile, with this applying in all three embodiments of the cover 502 described above.

The materials used for making the one-piece parts 503, 505, and 506, are selected so as to be suitable for retaining their mechanical properties even after being subjected to temperatures lying in the range −80° C. to +130° C. The material used may be polyoxymethylene, for example.

The invention is described above for use with a vial of content that has been freeze-dried. The invention is equally applicable when the content of the vial is not freeze-dried. Under such circumstances, the stopper 501 can be put into place on the vial 1 during a stage immediately following filling of the vial, and then the cover 502 can be put into place immediately afterwards, within a sterile enclosure (not shown) and by applying an axial force, thus likewise making it possible to reach a sealed configuration analogous to that of FIGS. 5, 14, and 23.

The technical characteristics of the invention described can be combined with one another. In particular, the ways in which the caps 506 and the covers 502 are assembled together can be interchanged between the first and third embodiments.

The invention claimed is:

1. A closure device for a container provided with a neck, said device comprising an elastomer stopper and a plastics material cover, suitable for covering both said neck and said stopper when in place in said neck, and including a ring suitable for surrounding said stopper and said neck in an assembled configuration, said ring being provided with locking means for locking on said neck, and a drive member suitable for being mounted on said ring with arbitrary angular orientation about a central axis of said ring, said drive member being provided with activator means for activating said locking means, said activator means including an annular edge of said drive member, said edge being suitable for being engaged between an outer skirt of said ring and at least one tab forming locking means and extending radially towards said axis from said skirt.

2. A device according to claim 1, wherein said ring includes an annular portion having an opening defined in the center thereof to give access to an exposed face of said stopper, in that said annular portion is connected to said skirt via a plurality of bridges extending to the vicinity of the locking tabs, and in that said bridges and said tabs together define an annular volume for receiving said annular edge of said drive member.

3. A device according to claim 1, including position-holding means for holding said member on said ring in a waiting position in which said activator means are not active and in which a thrust force generally parallel to an axis of symmetry of said neck can be transmitted from said drive member to said ring by said holding means.

4. A device according to claim 3, wherein said position-holding means constitute means for transmitting a thrust force to said ring, which force is generally parallel to an axis of symmetry of said neck.

5. A device according to claim 4, wherein said position-holding means and force-transmitting means extend radially inside said ring in a configuration in which the closure device is mounted on a container neck.

6. A device according to claim 4, wherein said force-transmission means includes at least one resilient tongue provided with a portion in relief extending radially outwards from said drive member and suitable for being engaged in an annular groove formed in an inside face of said ring.

7. A device according to claim 1, including holding means for holding said member on said ring in a locking position in which said annular edge actuates said locking tabs.

8. A device according to claim 7, wherein the holding means for holding said member in the locking position comprise at least one tongue having an outer portion in relief that is suitable for being engaged in an annular groove formed in an inside face of said ring.

9. A device according to claim 7, in which the means for holding said member in the locking position includes at least a portion of an outer radial rim of said drive member that is suitable for being engaged in an annular groove formed in an inside face of said ring.

10. A device according to claim 9, wherein said rim is inclined away from the activator means, going away from a central axis of said drive member.

11. A device according to claim 3, wherein said holding means comprise at least one portion in relief formed on said drive member and at least one complementary portion in relief formed on said ring, said portions in relief engaging when said member is in said waiting position and/or in said lock position.

12. A device according to claim 11, wherein said drive member carries two types of portions in relief suitable for being engaged respectively with a complementary common portion in relief of said when said member is in each of said waiting and locking positions.

13. A device according to claim 12, wherein said drive member carries at least two resilient tongues provided with portions in relief that extend to different distances from said annular edge, with said ring being provided with an annular groove for receiving said portions in relief.

14. A device according to claim 12, wherein said drive member carries at least one resilient tongue provided with a portion in relief suitable for being engaged with the complementary portion in relief of said ring when said member is in the waiting position, while said or each tongue is located in a window formed in a peripheral partition of said drive member, and in that the means for retaining the drive member in a configuration in which said second means activate the means for locking said ring extend over the outer face of said partition, between two such windows.

15. A device according to claim 2, wherein said drive member is provided with at least one hook suitable for engaging with said annular portion when said member is in a locking position.

16. A device according to claim 1, wherein said drive member includes two parts, namely:

- a generally annular part provided with said activation annular edge, said part being suitable for covering said stopper in part, leaving an opening for access to an exposed face of said stopper; and
- a cap releasably secured to said part while covering at least said opening, said cap being provided on its face directed towards said part with a centering portion in relief suitable for co-operating with a complementary portion in relief formed on a face of said annular part receiving said cap in order to bring a central axis of said cap substantially into alignment with a central axis of said opening.

17. A device according to claim 1, wherein said drive member is constituted by an annular element that carries the first and second means together with a cap immobilized on said annular element by means of tabs hooking onto the edge of a central opening in the annular element, and in that it is possible for said cap to be mounted on said annular element only by deforming said annular element elastically, said deformation being the result of a force that can be exerted only prior to said drive member being mounted on said ring.

18. A device according to claim 17, wherein each tab is provided with a catch for hooking onto said edge of said opening, with the distance between said catch and the face of said cap bearing against said annular element being less than the distance, as measured parallel to a central axis of said annular element when the cap is not fitted on said annular element, between said edge and a portion of the annular element that receives said face of said cap bearing thereagainst.

19. A method of mounting a closure device for a container provided with a neck, the device including an elastomer stopper and a plastics material cover, suitable for covering both the neck and the stopper when in place in the neck, and including a ring for surrounding the stopper and the neck in an assembled configuration, the ring being provided with locking means for locking on the neck, and a drive member mounted on the ring with arbitrary angular orientation about a central axis of the ring, the drive member being provided with activator means for activating the locking means, the activator means including an annular edge of the drive member, the edge being being engaged between an outer skirt of the ring and at least one tab forming locking means and extending radially towards the axis from the skirt, the drive member being constituted by an annular element that carries the first and second means together with a cap immobilized on said annular element by means of tabs hooking onto the edge of a central opening in the annular element, wherein it is possible for the cap to be mounted on the annular element only by deforming the annular element elastically, the deformation being the result of a force exerted only prior to the drive member being mounted on the ring and wherein the method comprising steps consisting in:

a) exerting on the edge of the central opening of the annular element a force that is generally parallel to a central axis of the opening, the force being applied against a side of the annular element opposite from the side via which the cap is to be mounted, the force being exerted to deform the edge elastically; and b) pressing the cap towards the annular element in a direction opposite to the direction of the force, so as to bring its hooking tabs into engagement against the elastically-deformed edge.

20. A container fitted with a closure device for a container provided with a neck, the device comprising an elastomer stopper and a plastic material cover covering both the neck and the stopper when in place in the neck, and including a ring surrounding the stopper and the neck in an assembled configuration, the ring being provided with locking means for locking on the neck, and a drive member being mounted on the ring with arbitrary angular orientation about a central axis of the ring, the drive member being provided with activator means for activating the locking means, wherein the activator means includes an annular edge of the drive member, the edge being engaged between an outer skirt of the ring and at least one tab forming locking means and extending radially toward the axis from the skirt.

* * * * *